US006845980B2

(12) United States Patent
Falciglia, Sr.

(10) Patent No.: US 6,845,980 B2
(45) **Date of Patent: *Jan. 25, 2005**

(54) BINGO-STYLE WORD GAME

(76) Inventor: Sal Falciglia, Sr., 386 Highview Ter., Ridgewood, NJ (US) 07450

( * ) Notice: Subject to any disclaimer, the term of this patent is extended or adjusted under 35 U.S.C. 154(b) by 0 days.

This patent is subject to a terminal disclaimer.

(21) Appl. No.: 10/442,760

(22) Filed: May 21, 2003

(65) Prior Publication Data

US 2004/0021267 A1 Feb. 5, 2004

Related U.S. Application Data

(63) Continuation of application No. 09/741,515, filed on Dec. 20, 2000, now Pat. No. 6,612,578.

(51) Int. Cl.[7] ..... A63F 71/00
(52) U.S. Cl. ..... 273/269; 273/272; 463/19
(58) Field of Search ..... 463/17, 18, 19, 463/20; 273/269, 272, 274, 299, 273, 139, 429, 153 R; 283/901, 903

(56) References Cited

U.S. PATENT DOCUMENTS

| | | | | | |
|---|---|---|---|---|---|
| 2,095,111 | A | * | 10/1937 | Triolo | 273/139 |
| 3,759,521 | A | * | 9/1973 | Breslow et al. | 273/243 |
| 4,270,754 | A | * | 6/1981 | Imatt | 273/273 |
| 5,393,057 | A | * | 2/1995 | Marnell, II | 463/13 |
| 5,647,798 | A | * | 7/1997 | Falciglia | 463/19 |
| 5,971,849 | A | * | 10/1999 | Falciglia | 463/16 |
| 6,015,346 | A | * | 1/2000 | Bennett | 463/20 |
| 6,241,246 | B1 | * | 6/2001 | Guttin et al. | 273/139 |
| 6,302,790 | B1 | * | 10/2001 | Brossard | 463/20 |
| 6,612,578 | B2 | * | 9/2003 | Falciglia, Sr. | 273/269 |

* cited by examiner

*Primary Examiner*—William M. Pierce
(74) *Attorney, Agent, or Firm*—Carter, DeLuca, Farrell & Schmidt, LLP

(57) ABSTRACT

A method of playing a bingo-style/word game in a game show or computer game format is provided. In accordance with the method, at least two players compete to correctly guess a puzzle phrase by alternately taking turns to reveal hidden clue words on a game board. A player who correctly guesses the puzzle phrase is awarded.

12 Claims, 16 Drawing Sheets

1. Celebrity–Elvis

| | | | | | |
|---|---|---|---|---|---|
| GC | H | I | P | S | * |
| G1 | O | FS | GC | DE | * |
| M | U | S | I | C | * |
| DE | N | | FS | G2 | * |
| | D | O | G | GC | * |
| * | * | * | * | * | * |

*FIG. 3A*

2. T.V– Studios USA shows

| | | | | | |
|---|---|---|---|---|---|
| M | A | U | R | Y | * |
| DE | | FS | | G1 | * |
| GC | X | | GC | FS | * |
| J | E | R | R | Y | * |
| G2 | N | GC | | DE | * |
| S | A | L | L | Y | * |

*FIG. 3B*

3. Place–School

| | | | | | |
|---|---|---|---|---|---|
| C | L | A | S | S | |
| GC | E | G2 | T | DE | T |
| G1 | A | DE | U | FS | E |
| G | R | A | D | E | S |
| GC | N | FS | Y | GC | T |
| * | * | * | * | * | * |

*FIG. 3C*

4. Thing–Peach

| | | | | | |
|---|---|---|---|---|---|
| F | U | Z | Z | Y | * |
| FS | R | DE | GC | | * |
| R | O | U | N | D | * |
| GC | G1 | GC | I | DE | * |
| | S | O | F | T | * |
| * | * | * | * | * | * |

*FIG. 3D*

5. Cinema–Psycho

| | | | | | |
|---|---|---|---|---|---|
| B | L | O | O | D | * |
| A | GC | G1 | DE | R | * |
| T | U | B | GC | A | * |
| E | FS | DE | G2 | I | * |
| S | | GC | FS | N | * |
| * | * | * | * | * | * |

*FIG. 3E*

6. TV–Cheers

| | | | | | |
|---|---|---|---|---|---|
| N | GC | DE | | G1 | * |
| W | O | O | D | Y | * |
| C | A | R | L | A | * |
| GC | S | A | M | FS | * |
| FS | DE | G2 | | GC | * |
| D | I | A | N | E | * |

*FIG. 3F*

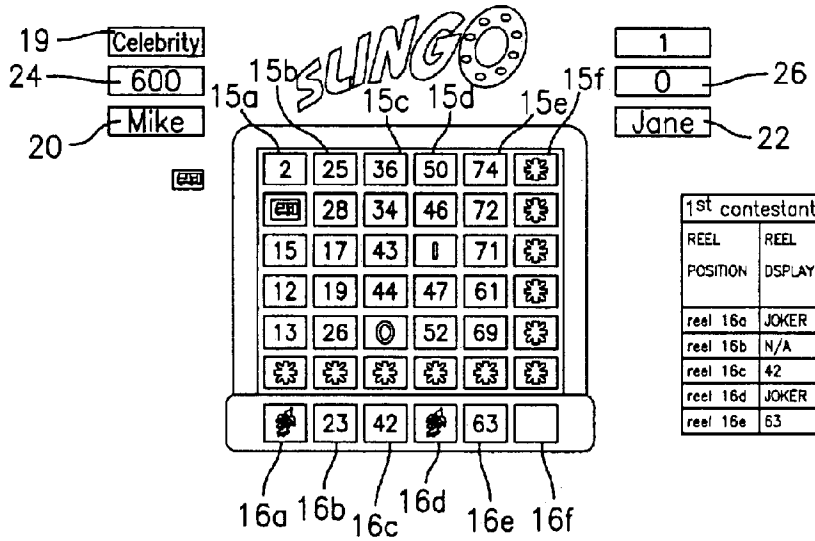

FIG. 4A

| 1st contestant – Mike's spin | | | | | |
|---|---|---|---|---|---|
| REEL POSITION | REEL DSPLAY | REEL/GAME BOARD MATCH | GAME–BOARD POSITION REVEALS | WINNINGS | TOTAL WINNINGS (1st contestant–Mike) |
| reel 16a | JOKER | YES(automatic) | gift icon under 3 | $200 | $200 |
| reel 16b | N/A | NO | N/A | 0 | $200 |
| reel 16c | 42 | YES | letter "O" under 42 | $200 | $400 |
| reel 16d | JOKER | YES(automatic) | letter "I" under 56 | $200 | $600 |
| reel 16e | 63 | NO | N/A | 0 | $600 |

FIG. 4B

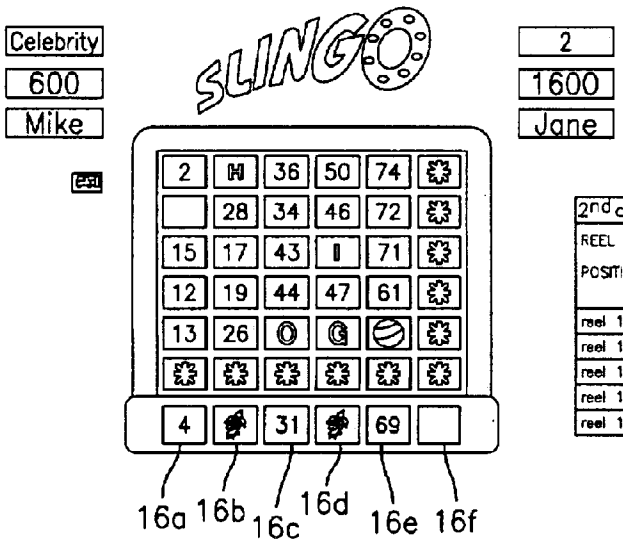

FIG. 5A

| 2nd contestant – Jane's spin | | | | | |
|---|---|---|---|---|---|
| REEL POSITION | REEL DSPLAY | REEL/GAME BOARD MATCH | GAME–BOARD POSITION REVEALS | WINNINGS | TOTAL WINNINGS (2nd contestant–Jane) |
| reel 16a | 4 | NO | N/A | 0 | 0 |
| reel 16b | JOKER | YES(automatic) | letter "H" under 25 | $200 | $200 |
| reel 16c | 31 | YES | N/A | 0 | $200 |
| reel 16d | JOKER | YES(automatic) | letter "G" under 52 | $200 | $400 |
| reel 16e | 69 | YES | gold coin | $1200 | $1600 |

FIG. 5B

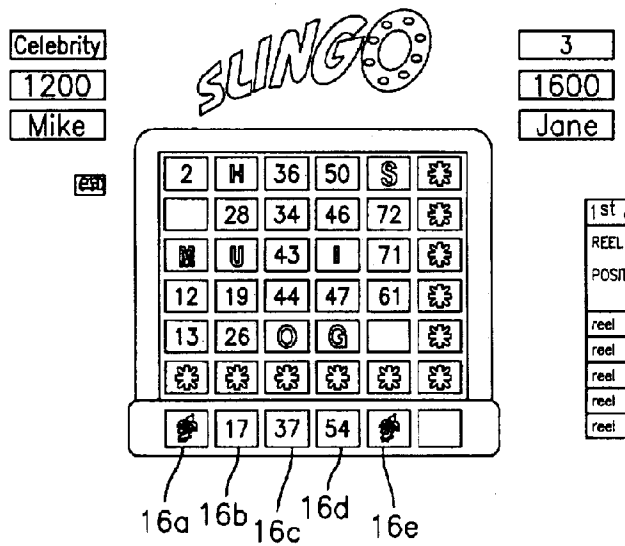

FIG. 6A

| 1st contestant – Mike's spin | | | | | |
|---|---|---|---|---|---|
| REEL POSITION | REEL DSPLAY | REEL/GAME BOARD MATCH | GAME-BOARD POSITION REVEALS | WINNINGS | TOTAL WINNINGS (1st contestant-Mike) |
| reel 16a | JOKER | YES(automatic) | letter "M" under 15 | $200 | $800 |
| reel 16b | 17 | YES | letter "U" under 17 | $200 | $1000 |
| reel 16c | 37 | NO | N/A | 0 | $1000 |
| reel 16d | 54 | NO | N/A | 0 | $1000 |
| reel 16e | JOKER | YES(automatic) | letter "S" under 74 | $200 | $1200 |

FIG. 6B

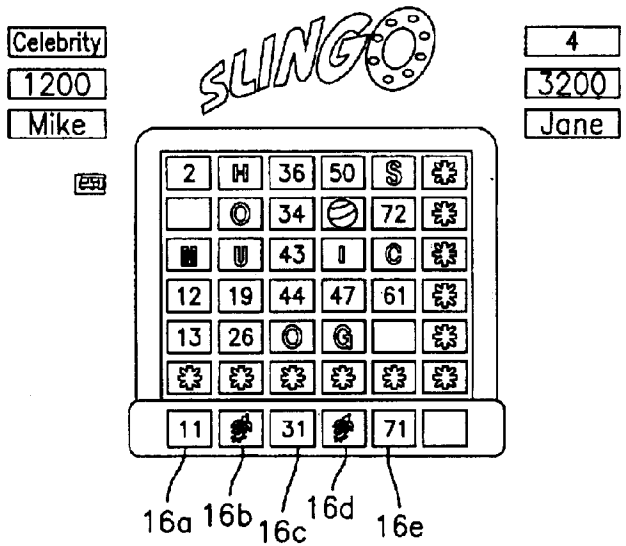

FIG. 7A

| 2nd contestant – Jane's spin | | | | | |
|---|---|---|---|---|---|
| REEL POSITION | REEL DSPLAY | REEL/GAME BOARD MATCH | GAME-BOARD POSITION REVEALS | WINNINGS | TOTAL WINNINGS (2nd contestant-Jane) |
| reel 16a | 11 | NO | N/A | 0 | $1600 |
| reel 16b | JOKER | YES(automatic) | letter "O" under 28 | $200 | $1800 |
| reel 16c | 31 | NO | N/A | 0 | $1800 |
| reel 16d | JOKER | YES(automatic) | gold coin UNDER 46 | $1200 | $3000 |
| reel 16e | 71 | YES | N/A | $200 | $3200 |

FIG. 7B

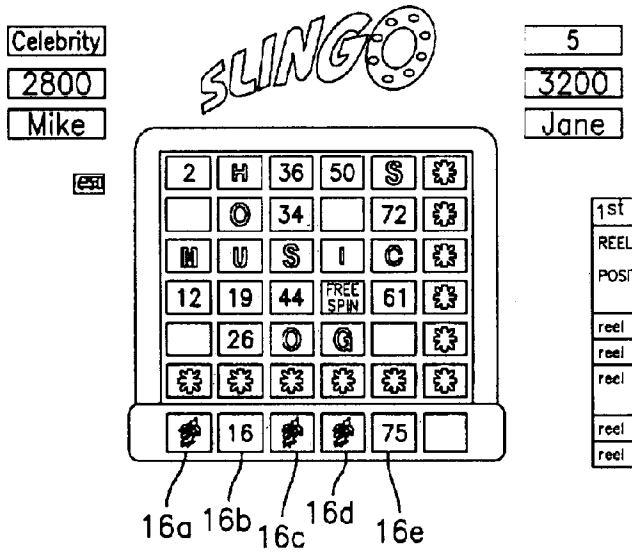

FIG. 8A

| 1st contestant – Mike's spin | | | | | |
|---|---|---|---|---|---|
| REEL POSITION | REEL DSPLAY | REEL/GAME BOARD MATCH | GAME-BOARD POSITION REVEALS | WINNINGS | TOTAL WINNINGS (1st contestant-Mike) |
| reel 16a | JOKER | YES(automatic) | blank under 13 | $200 | $1400 |
| reel 16b | 16 | NO | N/A | 0 | $1400 |
| reel 16c | JOKER | YES(automatic) | letter "S" and the clueword "MUSIC" | $1200 | $2600 |
| reel 16d | JOKER | YES(automatic) | free spin under 47 | $200 | $2800 |
| reel 16e | 75 | NO | N/A | 0 | $2800 |

FIG. 8B

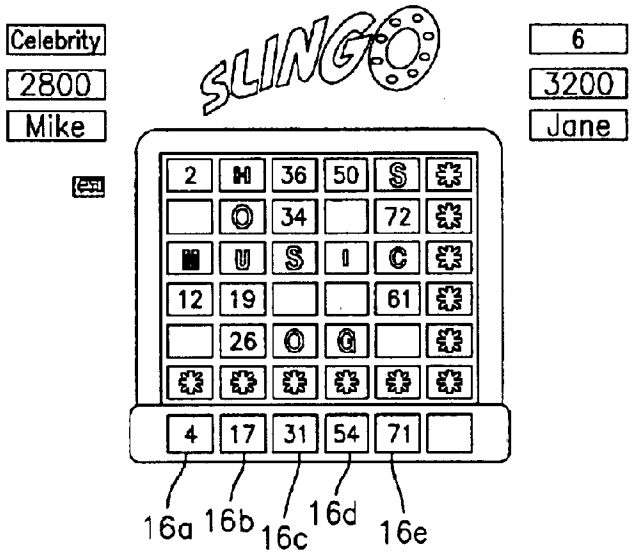

FIG. 9A

| 1st contestant – Mike's free spin | | | | | |
|---|---|---|---|---|---|
| REEL POSITION | REEL DSPLAY | REEL/GAME BOARD MATCH | GAME-BOARD POSITION REVEALS | WINNINGS | TOTAL WINNINGS (1st contestant-Mike) |
| reel 16a | 4 | NO | N/A | 0 | $2800 |
| reel 16b | 17 | NO | N/A | 0 | $2800 |
| reel 16c | 31 | NO | N/A | 0 | $2800 |
| reel 16d | 54 | NO | N/A | 0 | $2800 |
| reel 16e | 71 | NO | N/A | 0 | $2800 |

FIG. 9B

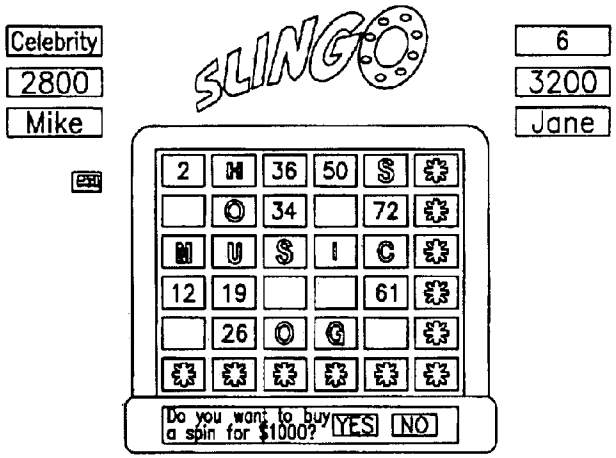
FIG. 10
1st contestant – Mike's spin
| REEL POSITION | REEL DSPLAY | REEL/GAME BOARD MATCH | GAME-BOARD POSITION REVEALS | WINNINGS | TOTAL WINNINGS (1st contestant-Mike) |
|---|---|---|---|---|---|
| reel 16a | 14 | NO | N/A | 0 | $2800 |
| reel 16b | 25 | NO | N/A | 0 | $2800 |
| reel 16c | 44 | YES | blank | $200 | $3000 |
| reel 16d | 50 | YES | letter "P" | $200 | $3200 |
| reel 16e | JOKER | YES(automatic) | cherub | $200 | $4800 *cherub doubles winnings total |
FIG. 11B
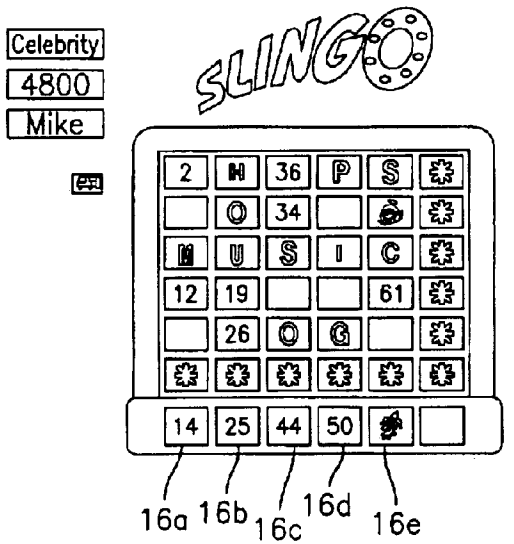
FIG. 11A 2nd contestant – Jane's spin
| REEL POSITION | REEL DSPLAY | REEL/GAME BOARD MATCH | GAME-BOARD POSITION REVEALS | WINNINGS | TOTAL WINNINGS (2nd contestant–Jane) |
|---|---|---|---|---|---|
| reel 16a | 3 | NO | N/A | 0 | $3200 |
| reel 16b | JOKER | YES(automatic) | letter "D" and clueword "DOG" | $1200 | $4400 |
| reel 16c | JOKER | YES(automatic) | letter "I" | $200 | $4600 |
| reel 16d | 55 | NO | N/A | 0 | $4600 |
| reel 16e | 61 | YES | gift card | $200 | $4800 |
FIG. 12B
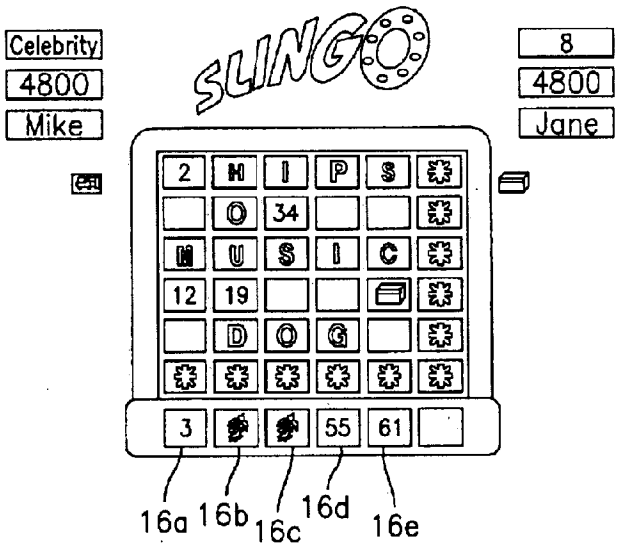
FIG. 12A
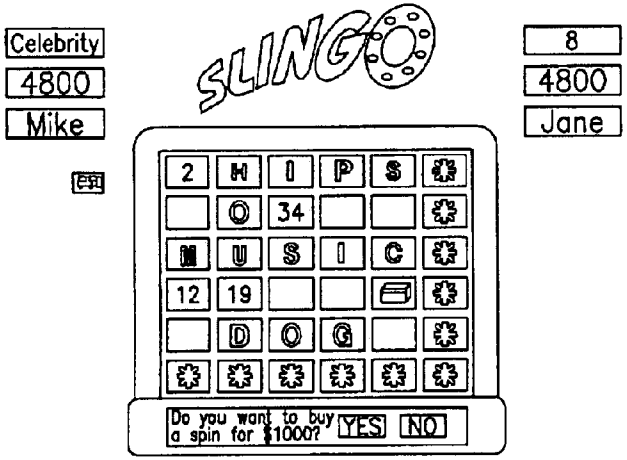
FIG. 13

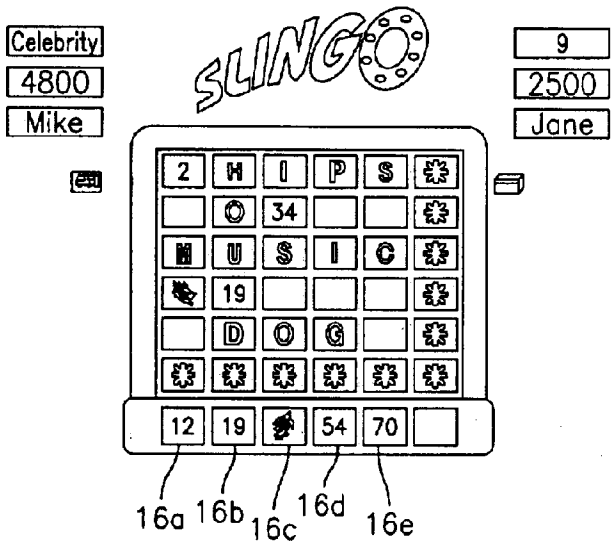

FIG. 14A

| 2nd contestant – Jane purchases a spin | | | | | |
|---|---|---|---|---|---|
| REEL POSITION | REEL DSPLAY | REEL/GAME BOARD MATCH | GAME-BOARD POSITION REVEALS | WINNINGS | TOTAL WINNINGS (2nd contestant–Jane) |
| reel 16a | 12 | YES | Devil | $200 | $2500 *Devil takes back 1/2 total winnings |
| reel 16b | spin is lost | | | | |
| reel 16c | spin is lost | | | | |
| reel 16d | spin is lost | | | | |
| reel 16e | spin is lost | | | | |

FIG. 14B

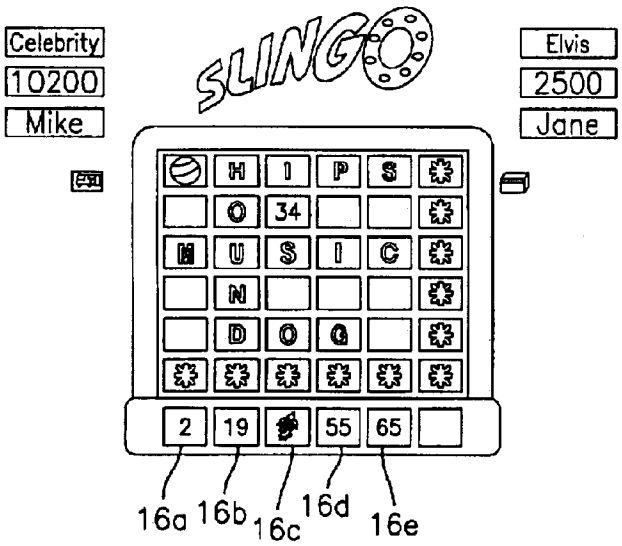

FIG. 15A

| 1st contestant – Mike's spin | | | | | |
|---|---|---|---|---|---|
| REEL POSITION | REEL DSPLAY | REEL/GAME BOARD MATCH | GAME-BOARD POSITION REVEALS | WINNINGS | TOTAL WINNINGS (1st contestant–Mike) |
| reel 16a | 2 | YES | gold coin | $1000 | $5800 |
| reel 16b | 19 | YES | letter "N" and clueword "HOUND" | $1200 | $7000 |
| reel 16c | JOKER | YES(automatic) | nothing | $200 | $7200 |
| reel 16d | 55 | NO | N/A | 0 | $7200 |
| reel 16e | 65 | NO | N/A | $200 | $7200 |

FIG. 15B

Picture #1 – Beginning of Spin 1
Partial Puzzle Display

Picture #9 – Puzzle Guessed

Picture #10 – Congradulations

BINGO-STYLE WORD GAME

PRIORITY

This application is a continuation application of a U.S. patent application filed on Dec. 20, 2000 and assigned U.S. patent application Ser. No. 09/741,515 now U.S. Pat. No. 6,612,578; the contents of which are incorporated herein by reference.

BACKGROUND OF THE INVENTION

1. Field of the Invention

The present invention relates generally to game shows particularly suited for television and, more particularly, to television game shows wherein both in-studio contestants and on-line (e.g., Internet) viewers are able to actively participate in the game show with the ability to win prize awards.

2. Description of the Related Art

Game shows have been and remain a staple of television broadcasting virtually from its inception as a broadcast medium. At the height of its popularity, a good game show can deliver some of the highest ratings on TV. Game shows present entertainment in the form of conflict. The conflict lies in the competition between the players for the prizes.

In the prior art, there are a number of bingo style games and word puzzle games, but none teach or suggest the combination of these games as taught by the present invention. That is, the applicant is not aware of any prior art which combines aspects of word puzzle games with aspects of the game of bingo. Accordingly, it is an object of the present invention to provide a method and apparatus for combining elements of the game of bingo with a word puzzle game in a television game show format.

It is another object of the present invention to provide a method and apparatus to play the TV format bingo/word game where at least two players can compete against each other.

It is another object of the present invention to provide a system and a method to allow Internet player participation by allowing on-line players to play along in real time with in-studio contestants.

SUMMARY OF THE INVENTION

In view of the prior art, the present invention provides a new unique game show system which enables in-studio contestants to play a unique game which combines aspects of the game of bingo with a word puzzle game.

In one aspect, the unique game show system is preferably embodied as a one-half hour television program in a studio setting where the studio set design reflects the colorful look, feel and excitement of a casino setting with a capacity to accommodate a large live audience. It is contemplated that the shows would be produced in casino showrooms such as Atlantic City or Las Vegas. Each show would preferably include four game puzzles and a bonus game.

According to another aspect, a game board is preferably displayed in the studio setting on a bank of video monitors. The studio setting would also include a spin lever or pull arm for each contestant podium to allow each contestant to take turns at playing the inventive game. It is also contemplated that in lieu of a spin lever or pull arm, each player's turn would be initiated automatically without any action required on the part of the contestants.

Each game is played between two in-studio contestants. The game is based upon a combination of aspects of the game of bingo with aspects of a word puzzle game to challenge individual participants to be the first to solve a puzzle phrase. A puzzle phrase is solved when one of the contestants correctly guesses the puzzle phrase using clue words as they are revealed to the contestants throughout the game on the game board.

In the present invention, two levels of participation are provided. First, as discussed above, at least two in-studio game contestants compete with each other to be the first player to solve a puzzle phrase. Second, an on-line audience is allowed to actively participate along with the in-studio contestants. In the preferred embodiment, the on-line audience participates by receiving a streaming video feed including program audio which originates from a television studio broadcasting the inventive TV game show.

A method for playing a TV game show wherein at least two players compete to be first to solve a game puzzle phrase generally comprises the steps of: providing a game board comprising a matrix of cells configured in a column and row orientation; displaying on each of said cells a random number; concealing, at a subset of said cells, letters comprising at least one clue word; and revealing at least one letter of said letters of said at least one clue word to partially and/or fully reveal the at least one clueword.

These steps are preferably implemented as a set of programmable instructions processed optionally in a general purpose processor or a hard-wired special-purpose processor.

BRIEF DESCRIPTION OF THE DRAWINGS

The foregoing features of the present invention will become more readily apparent and may be understood by referring to the following detailed description of an illustrative embodiment of the present invention, taken in conjunction with the accompanying drawings, where:

FIGS. 3*a–f* are illustrations of 6 representative game puzzle templates showing the predetermined concealed positions of cluewords and gameboard icons;

FIGS. 4*a–b*–15*a–b* are illustrations showing the progression and end result of an exemplary game according to an embodiment of the present invention;

DETAILED DESCRIPTION OF THE PREFERRED EMBODIMENTS

The preferred embodiment shown in the accompanying figures, and detailed hereinafter, describes a system and method used to play a TV game show known as, and trademarked under the trademark TV SLINGO™. It will be evident that the same method which allows TV SLINGO™ to be played as a TV game show can also be used to allow TV SLINGO™ to be played as a computer/video game, board game or other format.

In the game show system of the present invention, two distinct levels or types of active participation are provided.

In particular, the conventional, limited group of on-camera participants are provided. However, on-line viewers are able to actively participate in the game, independently from the on-camera participants, eligible to win prize awards.

Dealing first with the in-house (i.e., on-camera) aspect of the game show system of the present invention, at least two contestants compete with each other before a live studio audience in order to win money and prizes.

Figure 1:
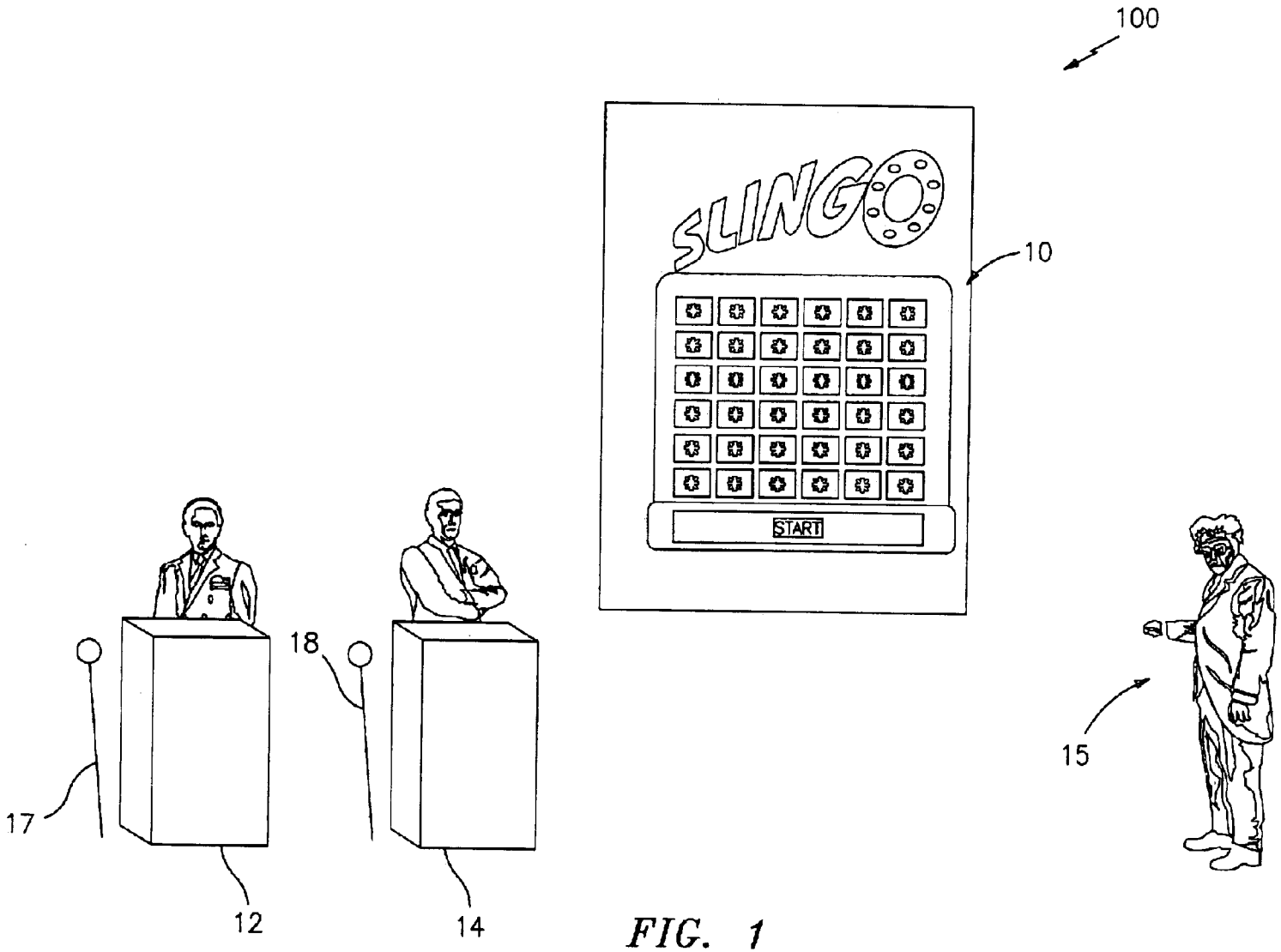
FIG. 1 is a view of a studio setting in which the inventive television game show is conducted according to an embodiment of the present invention.

FIG. 1 illustrates one embodiment of a studio setting 100 for playing the TV SLINGO™ game show. In this embodiment, the studio setting includes a game board 10 for playing TV SLINGO™, two contestant podiums 12, 14 where each podium includes a slot machine style activating arm 17, 18. The game board 10 of FIG. 1 illustrates a typical curtain graphic which can be displayed on each of the video monitors at the beginning of the game show.

In the embodiment of FIG. 1, two on-camera contestants compete with each other by attempting to solve a game phrase using clue words which are hidden behind particular cells of the game board 10. As letters of the clue words are revealed the contestants can guess or identify individual clue words. The overall objective of the game is to use the revealed clue words to try to solve the game puzzle phrase. A game show host 15 moderates the progression of the game show.

During the competition phase of the game, which is more fully described below, each contestant takes alternate spins to match numbers and Jokers (i.e., wild cards) appearing in reels situated below the gameboard to corresponding numbers on the game board.

Figure 2:
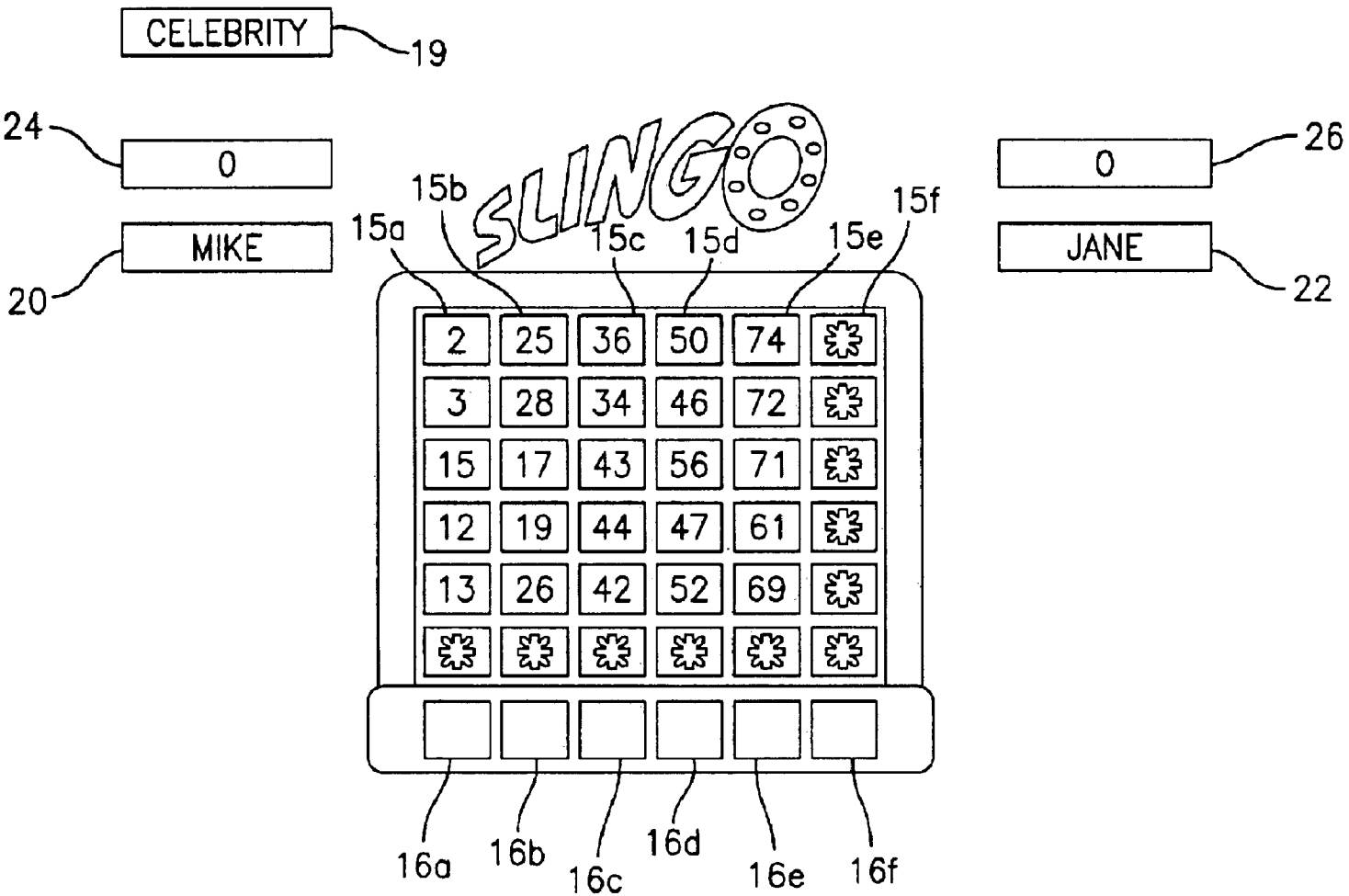
FIG. 2 is a detailed illustration of a front view of a preferred embodiment of the game board of FIG. 1.

FIG. 2 is a more detailed illustration of a front view of a preferred embodiment of the game board 10 of FIG. 1 designed for playing the game of TV SLINGO™ The game board 10 is made up of a matrix of cells configured in a column and row orientation, as would be typically found on a bingo game card. The cells are preferably embodied as a series of video monitors or television screens for displaying the various graphics associated with the inventive game. It is also contemplated that the cells may be displayed by other display technologies not explicitly described herein.

At the start of a typical game, in a preferred embodiment, one of a predetermined number of game board configurations will be displayed. Typical game board configurations include 5×6, 6×5, 5×5 and 6×6 configurations. The 6×6 game board configuration represents the maximum game board configuration described herein. The present invention also contemplates the use of smaller and larger game board configurations, i.e., N×N where N is greater than 6 or less than 5.

FIG. 2 illustrates a 5×5 game board configuration which utilizes the first 5 rows and columns of the larger 6×6 configuration. The different game board configurations accommodate the varying size of the pre-constructed clue words.

The 5×5 game board 10 of FIG. 2 displays a random number at each cell of the 5×5 game board at the start of a typical game. The range of the random number displayed at each cell (i.e., video monitor) of the game board is determined by the column in which the video monitor is located. For example, video monitors in the first column 15*a* of the game board 10 will always display random numbers in the range 1–15. Similarly, video monitors in the second column 15*b* of the game board 10 will always display random numbers in the range 16–30, video monitors in the third column 15*c* will always display random numbers in the range 31 through 45, video monitors in the fourth column 15*d* will always display random numbers in the range 46 through 60, video monitors in the fifth column 15*e* will always display random numbers in the range 61–75, and video monitors in the sixth column 15*f*, will always display random numbers in the range 76–90. The random numbers are generated such that no random number will appear twice within the game board.

Further, directly below the game board 10 there is shown six separate video monitors which simulate slot machine display windows, 16*a*, 16*b*, 16*c*, 16*d*, 16*e*, and 16*f*, referred to hereinafter as a reel 16. Each of the six displays (i.e., video monitors) in the reel is associated with the particular column of the game board 10 in which it is situated. For example, the first video monitor 16*a* corresponds to the first column 15*a* of the game board 10, the second video monitor 16*b* corresponds to the second column 15*b*, and so forth. Further, in addition to the game board 10 and the reel 16, there is also shown a "Category" window 19, a "First player identification" window 20, a "Second player identification" window 22, a "First player cumulative winnings" window 24, and a "Second player cumulative winnings" window 26.

Each video monitor 16*a–e* in the reel 16 displays a range of numbers which correspond to the range of numbers displayed within the associated column of the game board 10. For example, the first reel 16*a* corresponds to the first column 15*a* of the game board 10 and displays numbers in the range of the first column 15*a*, that is, numbers 1 through 15. Similarly, the second reel 16*b* corresponds to the second column 15*b* of the game board 10 and displays numbers in the range of the second column 15*b*, that is, numbers 16 through 30, the third reel 16*c* corresponds to the third column 15*c* of the game board 10 and displays numbers in the range 31 through 45, the fourth reel 16*d* corresponds to the fourth column 15*d* of the game board and displays numbers in the range 46 through 60, the fifth reel 16*d* corresponds to the fifth column 15*e* and displays numbers in the range 61 through 75, and the sixth reel 16*e* corresponds to the sixth column 16*f* and displays numbers in the range 76 through 90. In addition to each reel displaying the range of numbers recited above, a "Joker" game board icon may be displayed at each reel position to indicate the occurrence of a "wild-card". It is noted that symbols other than those described herein may be used to carry out the general principles of the game.

It has been found that a word-puzzle game played on in this and similar embodiments can be enhanced when the cells of the game board 10 include special game board icons in addition to the random numbers displayed. Examples of special game board icons which have been found to enhance the game include a "Free Spin" position which would allow the player an extra spin if displayed; a "Devil" position which would immediately eliminate a predetermined amount of accumulated winnings to that point in the game; a "Gold Coin" position which would grant the player additional winnings (e.g., $1000) if displayed; a "Gift" position which grants the player that gift upon successfully solving the puzzle phrase; a "Cherub" position which double the players winnings to that point; and a "Blank" position in which no reward is received.

To begin playing the game, a game puzzle category is announced to the two contestants and the audience. Game puzzle categories include, for example, people, places, things, cinema, topical events, history, pop culture, celebrity, entertainment, literature, etc. Each game puzzle can include 3 to 6 clue words concealed behind certain cells of the game board 10. The number of clue words will influence the difficulty and duration of each game puzzle. The clue words are preferably from 2 to 6 letters in length and can be positioned vertically, horizontally, and diagonally. The placement of the first letter of a clue word can start in any column or row of the game board 10. No clue word is reversed. Whenever a clue word with fewer than 6 letters is revealed any remaining numbered squares in that column or row are not affected. It is contemplated that more than one letter may be concealed behind a cell of the game board in an alternate embodiment.

FIGS. 3*a–f* illustrate 6 representative game puzzle templates. The game puzzle categories for each of the six templates include: celebrity, T.V., place, thing, cinema, and T.V. Referring to the first game puzzle, the game puzzle phrase to be determined by the contestants is "ELVIS". The first game puzzle includes a number of clue words, namely, "hound", "hips", "dog" and "music", which are intended to be collectively suggestive of the game puzzle phrase, "ELVIS". The first game puzzle further shows the selected positions of the game icons including: GC=gold coin, DE=devil, G1=gift one, G2=gift two and FS=free spin.

The ultimate object of the game is to be the first player to correctly guess the game puzzle phrase (e.g., ELVIS) in a chosen category (e.g., celebrity) using the clue words hidden behind certain squares of the game board 10, as shown by FIGS. 3*a–f*. To achieve this object, two contestants take alternate spins to match numbers and Jokers (i.e., wild cards) appearing in the reel 16 with numbers appearing on the game board 10 structured in a bingo style format. Each match of a game board cell with its corresponding reel reveals either a letter associated with a hidden clue word, a game symbol, or a blank. As the letters of the clue words are revealed the players can guess at individual clue words and/or at the game puzzle word. When a clue word is identified by a contestant it changes to a predetermined color and the player is awarded winnings. If a player identifies a clue word and does not solve the puzzle, the contestant is entitled to buy one spin for some stipulated dollar amount, for example $1000. Free spins are occasionally awarded throughout the game. In the event a free spin is awarded to a player it must be used immediately in the preferred embodiment. When all clue words of a puzzle have been revealed without either contestant correctly guessing the game puzzle phrase, a host will indicate this fact to each contestant. If after all clue words are revealed and a contestant does not solve the puzzle phrase, the contestant's opponent is given one chance to solve the puzzle phrase. If both contestants are unable to solve the puzzle phrase, a host will offer a helpful final verbal clue to both contestants. A player who solves the puzzle phrase is awarded a predetermined dollar amount, e.g., $3000, in addition to any winnings accumulated to that point.

Alternate variations on the game can be made. For example, one can vary the amount of money awarded for a successful spin (i.e., making a match), the point at which a free spin must be used, the dollar amount for purchasing a spin, and so on. It is further noted that various embodiments can be fully incorporated into software and played on a computer or similar device. Alternatively, various embodiments may be implemented as a video game or hand-held video game.

Unique aspects of the game will be now be described with reference to FIGS. 4–19. The game is played in a series of rounds with each player accumulating winnings. After some number of rounds, the player who is first to correctly guess the puzzle phrase is allowed to keep his or her winnings. The player who wins a majority of the games played during a single broadcast session (e.g., 3 out of 5 games) advances to a bonus round.

FIG. 4*a* illustrates the game board 10 just after a first contestant took a first turn. Specifically, FIG. 4*a* illustrates a 5×5 game board configuration displaying a random number in each cell of the 5×5 game board 10 with three of the numbers removed. FIG. 4*b* concisely summarizes the game steps illustrated in FIG. 4*a*.

To begin playing the game a host announces a category to two contestants and the audience. In the example, the chosen category is "celebrity". Generally, the game proceeds by two players taking alternate spins to match numbers and Jokers (i.e., wild cards) appearing in the reels 16*a–e* with corresponding numbers on the 5×5 game board 10. The game begins by one of the two contestants pulling his/her activating arm 17, 18 thereby causing the reels 16*a–e* to simulate a spinning action in a known slot machine type manner. After the reels 16*a–e* simulate a spinning action, for a period of time, each reel 16*a–e* will display either a random number or a Joker. If a random number in a reel 16*a–e* matches a number within the corresponding column in the game board 10, that number in the game board column will then be revealed to display either a letter of a clue word, a game symbol, or a blank. Otherwise, if a Joker is displayed in a reel, the player then has the option to select which of the cells within the column corresponding to the Joker is to be uncovered.

Referring to FIG. 4*a*, in the example, a first contestant, "Mike", pulls his activating arm thereby causing the reel 16 to display a "joker", "23", "42", "joker", and a "63" in the respective reels 16*a–e*. Taking each reel display in turn, the "joker" in reel 16*a* provides contestant Mike with the option to choose any of the random numbers in the first column 15*a* as a match. Mike decides to choose the cell labeled "3" which is found in the second row of the first column 15*a* to be revealed. The cell labeled "3" reveals a gift icon which is shown to the left of the game board as corresponding to a portion of Mike's accumulated winnings. In addition, Mike wins $200 for the match in the first column. Reel position 16*b* shows a "23" with no corresponding match in the game board 10. Reel position 16*c* shows a "42" which has a corresponding match in the game board 10 in the 5.sup.th row of the associated column. As such, the matching number reveals a letter "O", which is one letter of one the hidden clue words. The match contributes an additional $200 to Mike's winnings. Reel position 16*d* shows another "joker". In response contestant Mike selects random number "56" as a match to the joker. Underneath the game board cell labeled "56" there is revealed the letter "I" which is a letter of one of the hidden clue words. The match in reel position 16*d* earns contestant Mike an additional $200 bringing his total thus far to $600 for the three matches. Reel position 16*e* shows a "63 with no corresponding match in the game board 10. As such no additional money is earned and no further game board positions are revealed. All prize money won from each spin accumulates and is displayed in the winnings window 24.

FIGS. 5*a–b* illustrates the opponent's, Jane's, first turn. As shown in FIG. 5*a*, Jane reveals two letters of the game puzzle and in addition uncovers a gold coin symbol as a match in the fifth column 15*e* (i.e., reel 16*e*). The gold coin awards Jane with an additional $1000 above the $200 earned for making a match in the fifth column 15*e*. Jane's total earnings at the end of the round equal $1600, as displayed in the winnings window 26.

FIGS. 6*a–b* illustrate Mike's second turn. In this turn three additional letters of the puzzle are revealed earning Mike an additional $600, bringing his total winnings thus far to $1200.

FIGS. 7*a–b* illustrate Jane's second turn. In this turn an additional letter of the puzzle is revealed and a gold coin in respective reels 16*b* and 16*d*. Jane earns an additional $1600 in this round thereby bringing her winnings to $3200 thus far. It is further noted that to this point, four partial clue words have been revealed (i.e., _H___S, HOU___, MU_IC, ___O G). It is noted that either contestant, during his/her turn, may take a guess at a clue word. If a clue word is guessed correctly, the contestant is entitled to purchase an additional spin for some dollar amount (e.g., $1000). However, the player is required to have at least that amount available in current winnings to take advantage of the free spin opportunity.

FIGS. 8*a–b* illustrate Mike's third turn. Reel 16*c* reveals the letter "S" which completes one of the clue words (e.g., MUSIC). Preferably, when a clue word is revealed on the game board 10 it changes to a red color and the player is awarded winnings for revealing the clue word. Reel 16*d* constitutes a match in this turn which reveals a "free spin" special symbol. Preferably, free spins must be taken at the turn in which they are awarded. FIGS. 9*a–b* illustrate the result of the free spin awarded at Mike's third turn. FIGS. 9*a–b* illustrated no matches in any of the reels 16*a–e* for the free spin. As such, Mike's winnings at the end of his third turn remain constant at $2800.

FIG. 10 illustrates a game feature in which the player is afforded an opportunity to purchase an additional spin for revealing a clue word. In the example, contestant Mike reveals the clue word "MUSIC" at his third turn (See, FIGS. 8*a–b*) and chooses to purchase a spin for revealing the clue word.

FIGS. 11*a–b* illustrate the result of contestant Mike's purchased spin. In this spin a "blank", a letter "P", and a "cherub" are revealed at respective columns 15*c*, 15*d* and 15*e*. Revealing a blank and a letter "P" earn Mike an additional $400 and revealing the cherub earns Mike an additional $200 plus a doubling of his earnings to this point.

FIGS. 12*a–b* illustrate Jane's third turn. As shown, at this turn two clue words "DOG" and "HIPS" are revealed, the letter "I", and a gift card, at columns 15*b*, 15*c* and 15*e*, respectively. Revealing a single clue word affords Jane the option to purchase a spin for $1000, as shown in FIG. 13.

FIGS. 14*a–b* illustrate the result of Jane's purchased spin. As shown at reel 16*c*, a "devil" comes up which effectively terminates the spin. In addition, one-half of Jane's total accumulated winnings thus far are lost.

FIGS. 15*a–b* illustrate Mike's fourth turn. In this turn, the letter "N", a "gold coin", and the clue word "HOUND" are revealed earning contestant Mike an additional $2400 in earnings ($200 for each match, $1000 for revealing the gold coin, and $1000 for revealing the clue word HOUND). At this point all of the clue words in the game board 10 are revealed. Contestant Mike offers to guess at the game puzzle phrase and does so correctly as being "ELVIS". Correctly guessing the game puzzle phrase earns Mike an additional $3000. Contestant Mike's grand total is $10,200 plus the gift prize which are retained by Mike for winning the game.

In addition to the contestants participating in an average of four game puzzles per televised broadcast, the player winning a majority of games played is considered the overall winner and earns the right to participate in a bonus round. The bonus round is preferably played like a lightning round, lasting on the order of ninety seconds in duration.

In one embodiment, a three-spin bonus round is played. The bonus round puzzle contains only word clues and blank squares. That is, none of the special symbols are used (i.e., devil, cherub and gold coin). The bonus round is similar in many respects to the typical game described above, however, the rules of the bonus round differ in some respects from the typical game. In the three-spin bonus round, a player has the option after taking spin 1 or 2 to solve the puzzle phrase. If a player commits to solve the puzzle phrase and gives an incorrect answer, the bonus round ends. Only one guess is allowed in the bonus round. If a player chooses not to commit to solving the puzzle after the first two rounds, the player is allowed 10 seconds to solve the puzzle phrase.

The dollar value of the bonus round prize awarded for a correct guess will vary depending upon the spin in which the correct guess is made. The most expensive prize (e.g., an automobile) will be awarded if the puzzle is solved after the first spin. A prize award of lesser value (e.g., furniture) will be awarded if the puzzle is solved after the second or final spin.

Figure 16:
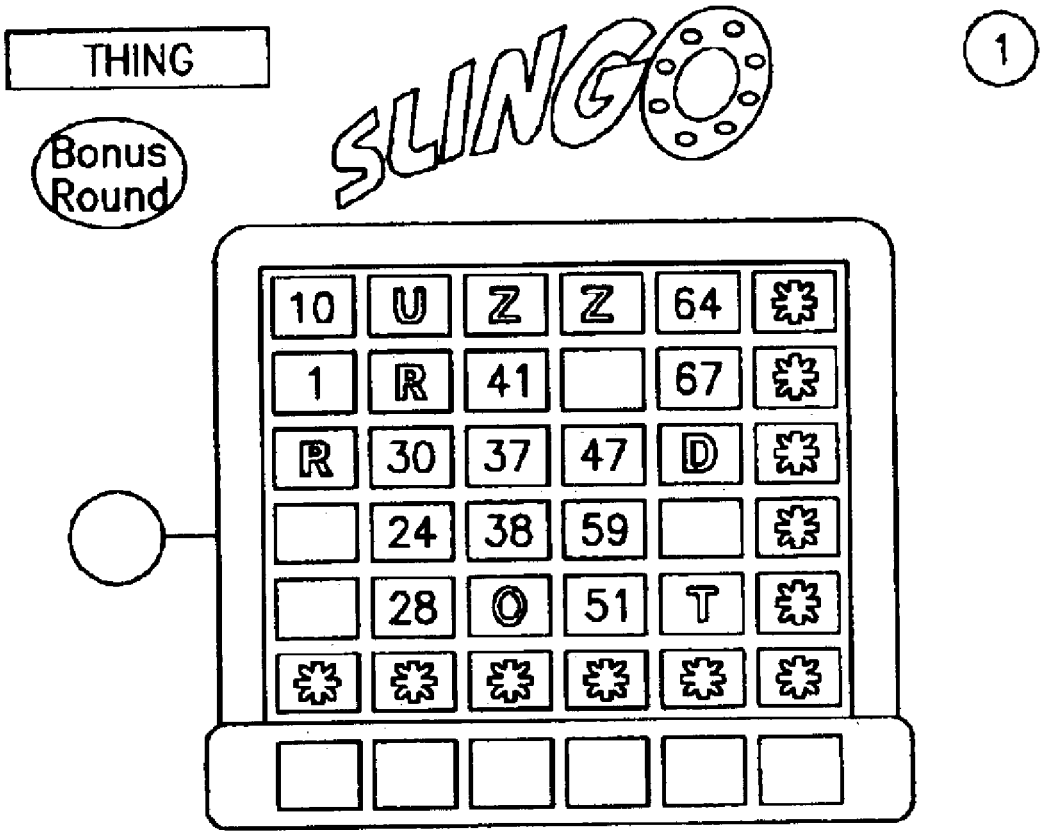
FIGS. 16–17*d* are illustrations showing the progression and end result of an exemplary bonus round game according to one embodiment of the present invention.

At the start of the bonus round, the game board 10 displays the curtain graphic shown in FIG. 16. An illustrative example of a typical bonus round will be described with reference to FIGS. 16–17*d*.

FIG. 16 illustrates the game board 10 upon announcing and displaying a puzzle category. As shown, a partial puzzle is displayed. Twelve cells of the game board 10 reveal blanks and certain letters of individual clue words.

Figure 17A:
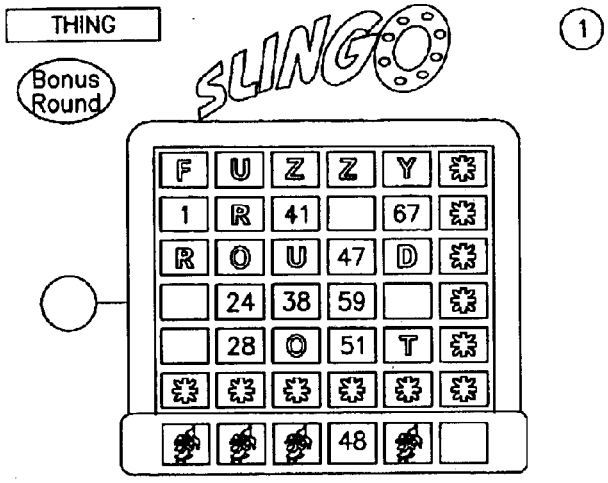
Figure 17B:
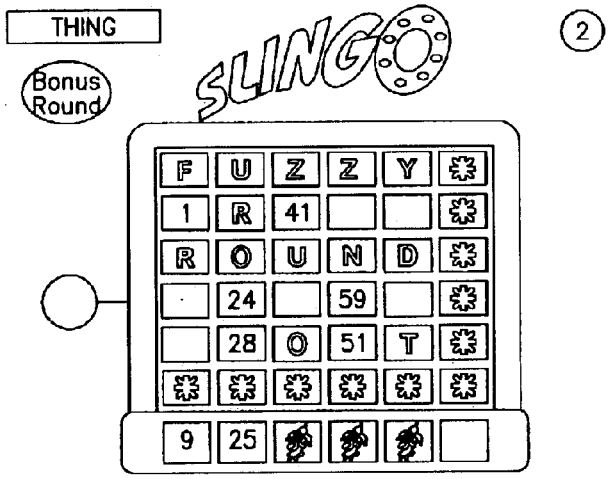
Figure 17C:
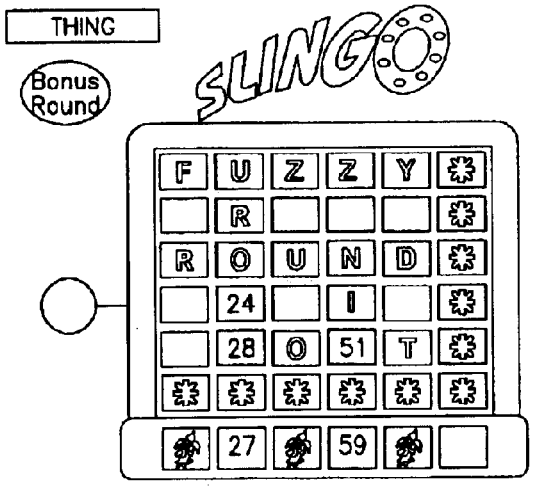
Figure 17D:
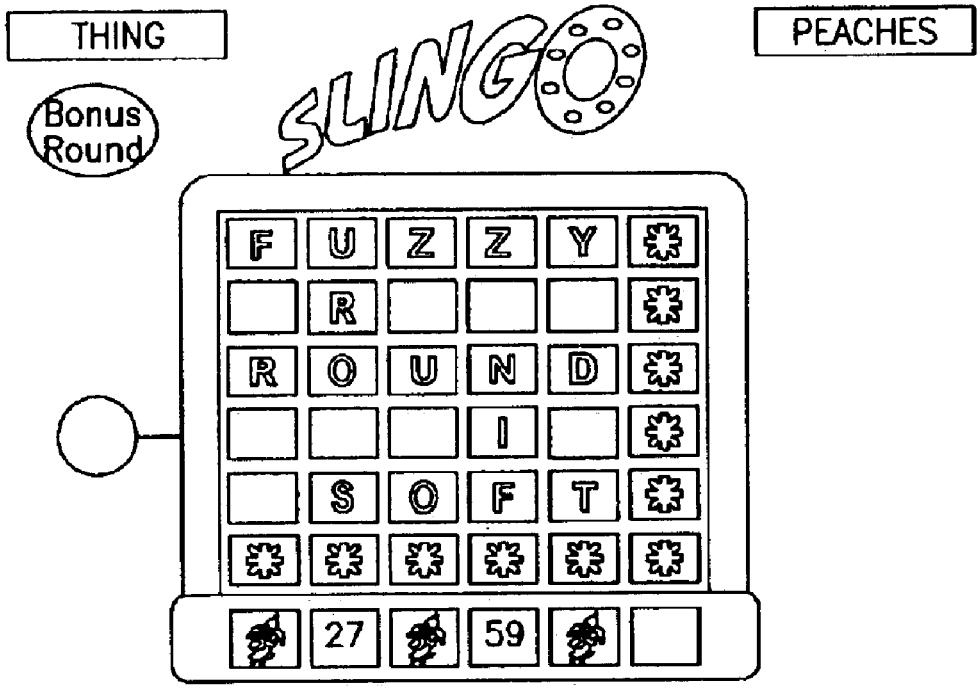

FIGS. 17*a–c* illustrate an exemplary three-spin bonus round in which all three spins are taken by the player. The contestant may take up to 3 spins in a similar manner to that described above for a typical game. FIG. 17*a* illustrates that the clue word "FUZZY" is revealed after a first spin. FIG. 17*b* illustrates that the clue word "ROUND" is revealed after the second spin. FIG. 17*c* reveals the clue word "FRUIT" after the third and final spin. At this point, the player can identify any remaining clue words or guess at the puzzle phrase. FIG. 17*d* illustrates the game board after all clue words are revealed. As shown, there was only a single clue word which remained to be revealed (i.e., "SOFT") at the completion of the bonus round.

Figure 18:
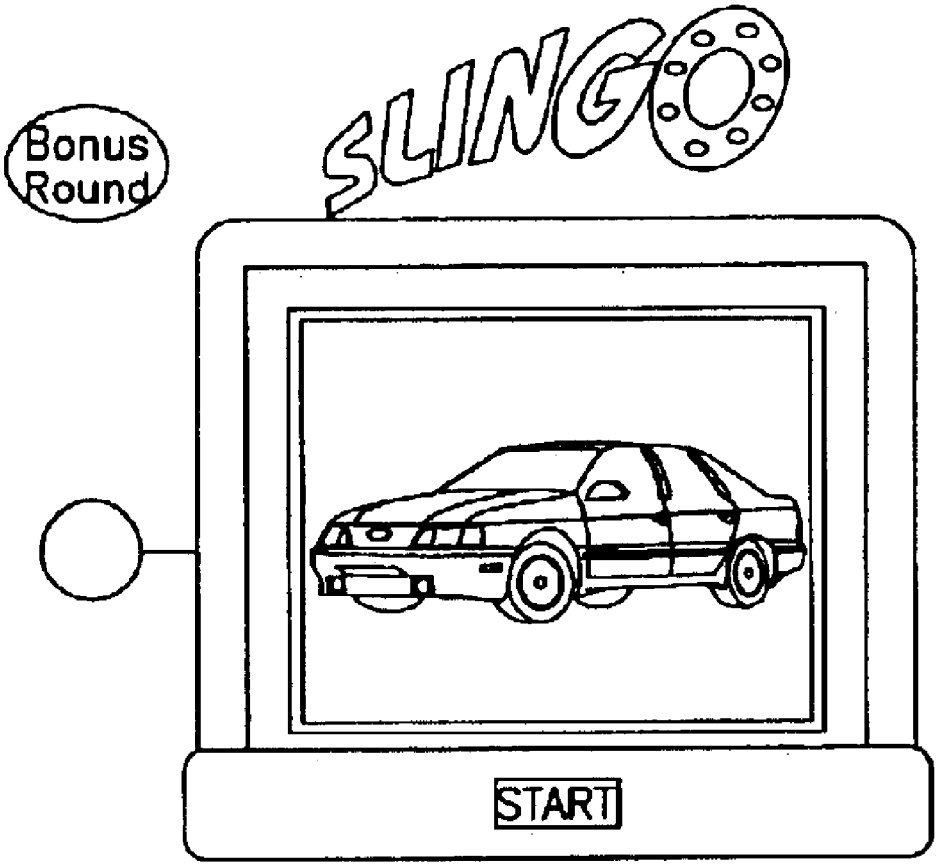
FIGS. 18–19*h* is an illustration showing the progression and end result of an exemplary bonus round game according to another embodiment of the present invention.

In another embodiment, a two-spin bonus round is played by the winner. Given that only 2 spins are allowed a prize of the largest denominational value is awarded for correctly guessing the puzzle phrase, such as an automobile. The automobile, or similarly valued prize is preferably displayed on game board 10 at the start of the two-spin bonus round, as illustrated in FIG. 18.

Figure 19A:
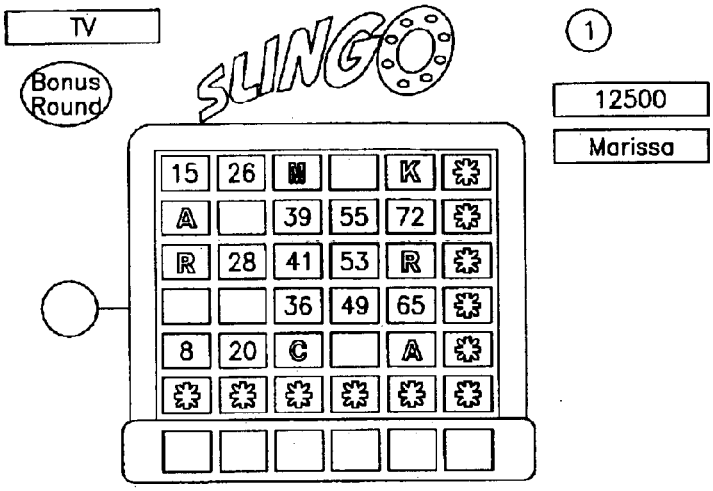

FIG. 19*a* illustrates the game board 10 upon announcing and displaying a puzzle category. As shown, a partial puzzle is displayed. Twelve cells of the game board 10 reveal blanks and some letters of individual clue words.

Figure 19B:
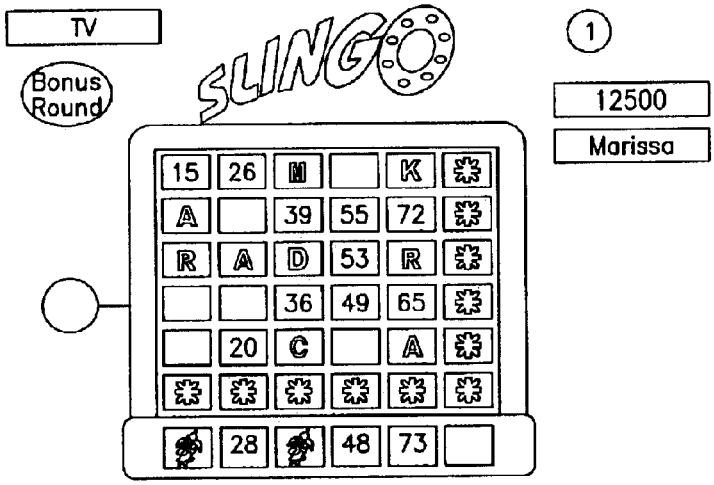
Figure 19C:
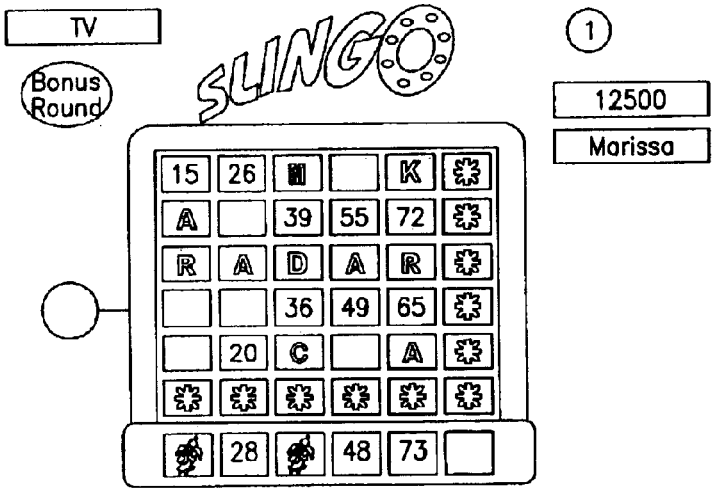

FIGS. 19*b–c* illustrate that two letters, i.e., "A" and "D", are revealed after the first spin and that the player has correctly guessed at the clue word "RADAR".

Figure 19D:
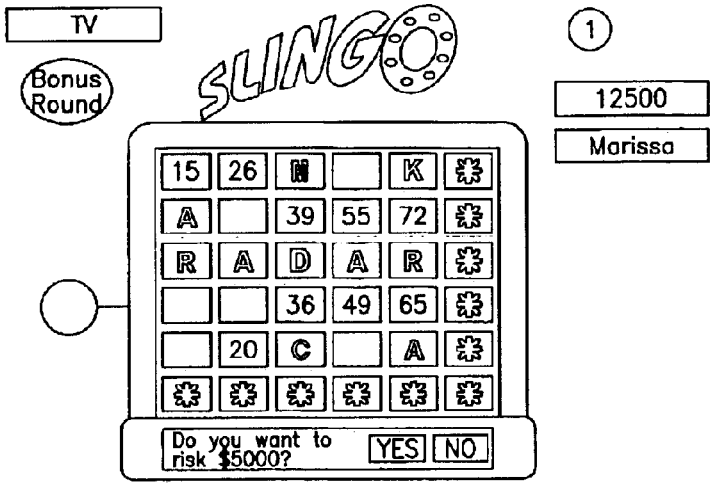

FIG. 19*d* illustrates a game option in which the player risks $5000 of prior accumulated winnings. In the two-spin bonus round, after a first spin a player may risk $5000 of accumulated winnings to be eligible to win the grand prize on a subsequent spin. If the player elects not to risk the $5000, the player will be eligible to win a prize whose denominational value is less than the grand prize.

Figure 19E:
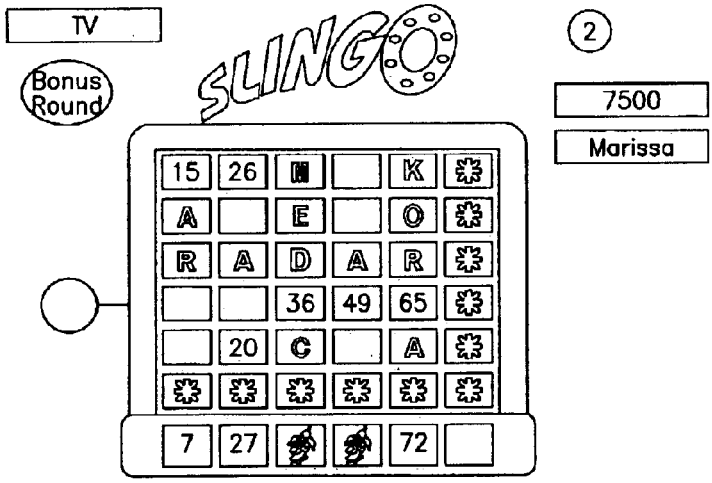
Figure 19F:
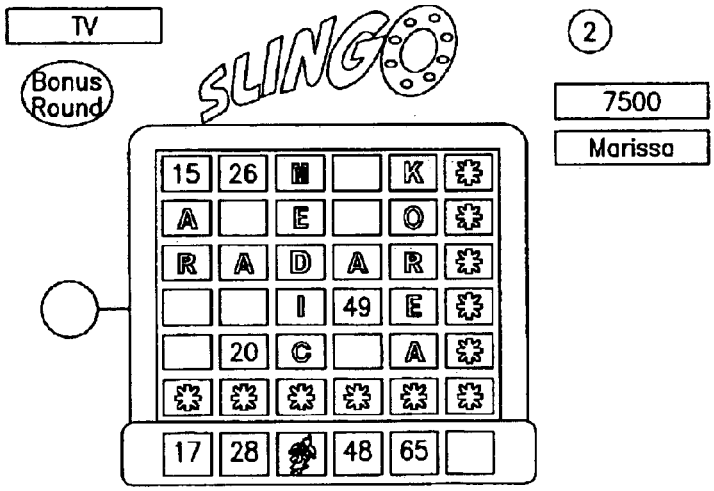

FIGS. 19*e–f* illustrate that the player has correctly guessed at the clue words "KOREA" and "MEDIC" after the second and final spin. At the end of this round the player guesses correctly at the puzzle phrase "MASH".

Figure 19G:
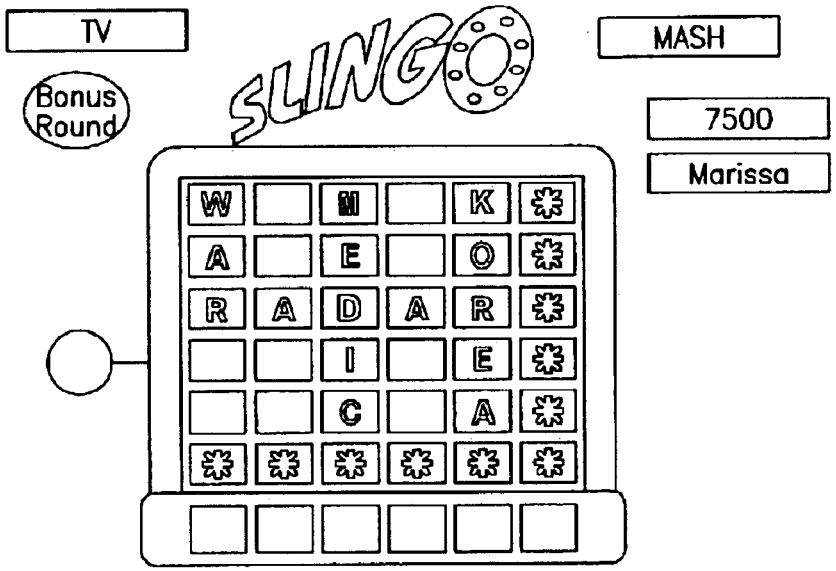
Figure 19H:
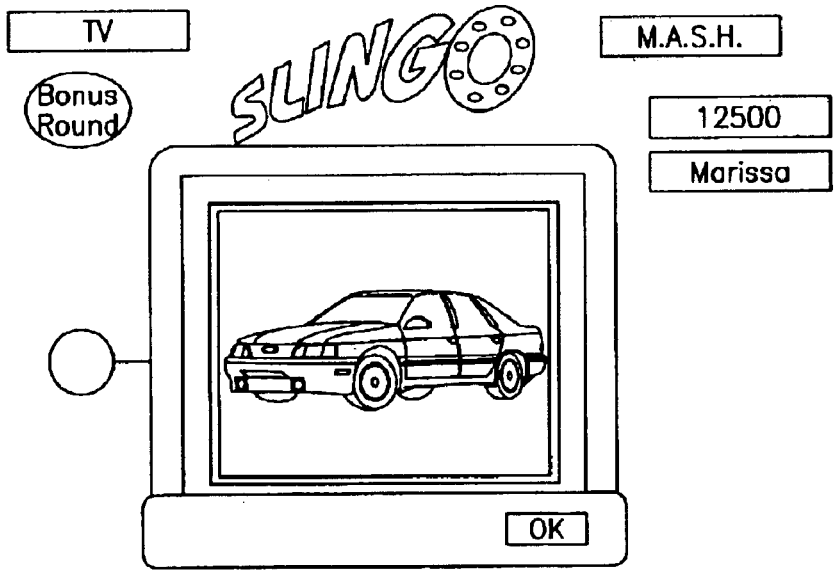

FIG. 19*g* illustrates the board with all clues fully revealed. FIG. 19*h* illustrates a congratulatory screen highlighting the grand prize.

In order to enable on-line viewers to interactively participate in the televised game show, a streaming video feed of the studio broadcast is provided over an electronic network, preferably the Internet, in real-time. Using a conventional PC terminal or the like, and standard network connection means, an on-line player can transmit a single guess as to what the on-line player believes to be a solution to the game puzzle. The network connection means may be, for example, but not limited to, a modem or an integrated services digital network (ISDN) connection to an on-line service provider network, a T1 line, a coaxial cable connection to a cable system interface and/or a cable modem, a local area network (LAN) or other networks, such as a wide area network (WAN) or medium area network (MAN), a satellite link, or an ISP connection to the Internet.

The guess is communicated, via the connection means, to a central server preferably located at the studio broadcast site. However, it is also contemplated that the central server may be located remote from the studio broadcast facility in an alternate embodiment. The central server may be managed by a managing authority that controls the administrative and technical aspects of remote play.

In one embodiment, an on-line player guess may be entered by an on-line player via an interactive dialogue box including a text field which is made available on the on-line players display monitor. The on-line player can submit a single guess at the puzzle answer after at least one clue is revealed on the game board 10. Each on-line player is allowed only a single guess per game puzzle. If an on-line player submits a correct guess, the player will receive a confirmation and a ranking (e.g., 1–100) from the central server. For example, the first 100 players to make a correct guess will be ranked according to the time at which the correct guess is received. If an incorrect guess is submitted, the viewer/player is notified and locked out from submitting a further guess for the same game puzzle.

In one embodiment, during game play, a counter is displayed on the TV broadcast feed displaying the number of successful on-line answers. It is contemplated that the top 100 on-line players, as determined by their respective ranking, will be awarded points. The points will be redeemable for prizes provided by sponsors of the inventive game show.

It is contemplated that on-line player participation will prove beneficial in two respects. First, existing players will become viewers and eventually participate on-line, and second, the availability of on-line participation will attract new television viewers.

In one embodiment, the studio broadcast is transmitted as a wireless signal, such as a radio-frequency (RF) signal, for example, to be received by a wireless receiving device such as a set-top box, or personal digital assistant (PDA), as an example.

In carrying out the studio portion of this invention, the television game show should be conducted in a manner which creates an atmosphere conducive to being fast-paced, exciting and challenging. It is preferred that the television game show run approximately one-half hour in duration, the studio setting should preferably reflect the colorful look, feel, and excitement of a casino setting with a large audience capacity, the game board 10 is preferably implemented as a monitor wall of 42 video monitors for displaying the game board matrix and the reels and each contestant would preferably be situated at a contestant podium including a spin lever or button. It is also contemplated that spins or turns can be initiated automatically without the assistance of the contestants to expedite the game.

The described method may be implemented as a set of programmable instructions to be processed optionally in a general purpose processor or a hard-wired special-purpose processor.

The present invention has been shown and described in what are considered to be the most practical and preferred embodiments. It is anticipated, however, that departures may be made therefrom and that obvious modifications will be implemented by persons skilled in the art. For example, points may be awarded instead of dollar amounts. As a further example, the points may be redeemed for dollars and/or prizes.

It will be understood that various modifications may be made to the embodiments disclosed herein and that the above description should not be construed as limiting, but merely as exemplifications of preferred embodiments. Those skilled in the art will envision other modifications within the scope and spirit of the claims appended thereto.

What is claimed is:

1. A method of playing a game show configured for being broadcast to a plurality of viewers, said method comprising the steps of:

providing at least one camera for broadcasting the game to the plurality of viewers;

providing a studio setting having a plurality of display cells configured in a column and row orientation and a group of display cells in proximity to the plurality of display cells and not overlaying the plurality of display cells, each display cell of said group of display cells corresponding to a subset of said plurality of display cells, said studio setting further having at least two locations each configured for enabling one of at least two contestants to be play the game, and a location configured for enabling a game show host to moderate the progression of the game, said studio setting being arranged to be within a field of view of said at least one camera;

randomly generating and displaying a random number on a face of each of said plurality of display cells;

having each of the at least two contestants during a corresponding turn cause one of a random number and non-numeric symbol be randomly generated and displayed on a face of each of said group of display cells;

matching said random numbers corresponding to said subset of said plurality of display cells with one of the random number and the non-numeric symbol randomly generated and displayed on the face of said corresponding display cell of said group of display cells;

revealing on the plurality of display cells, in the case of at least one match, at least one letter of at least one clue word to partially and/or fully reveal said at least one clue word; and repeating the matching and revealing steps until one of at least two contestants correctly determines a word or phrase associated with said partially and/or fully revealed clue words.

2. The method of claim 1, further including the step of determining a word or phrase related to said at least one partially and/or fully revealed clue word.

3. The method of claim 1, further comprising the step of announcing a category related to said word or phrase prior to said displaying step.

4. The method of claim 1, wherein the subset of display cells concealing said letters comprising the at least one clue word are contiguous display cells.

5. The method of claim 1, wherein the random number displayed on each of said plurality of display cells is non-repetitive.

6. The method of claim 1, further comprising the step of awarding points to at least one contestant of said at least two contestants after said revealing and determining steps.

7. The method of claim 1, further comprising the step of allowing at least one contestant of said at least two contestants who won the game to participate in a bonus round.

8. The method of claim 1, further comprising the step of concealing at another subset of display cells, icons having predetermined point values associated therewith.

9. The method of claim 1, wherein said revealing step comprises the steps of:

randomly generating and displaying in at least one display cell of said group of display cells associated with each column one of a non-numeric symbol and a random number;

comparing one of said randomly generated and displayed non-numeric symbol or random number displayed in the at least one display cell of said group of display cells with a subset of said random numbers displayed by the plurality of display cells to determine a match; and revealing one of the at least one letter of said letters of the at least one clue word and a non-alphanumeric symbol when said match is determined.

10. The method of claim 1, further comprising the step of allowing at least one contestant of said at least two contestants to purchase at least one additional turn.

11. The method of claim 1, further comprising the step of allowing at least one contestant to use at least one additional turn immediately after obtaining the at least one additional turn.

12. The method of claim 1, further comprising the step of announcing to the at least two contestants that all clue words have been revealed.

* * * * *